US005366561A

United States Patent [19]

Ginn

[11] Patent Number: 5,366,561

[45] Date of Patent: Nov. 22, 1994

[54] AIR PREHEATER CLEANING METHOD

[75] Inventor: Christopher C. Ginn, Houston, Tex.

[73] Assignee: Butterworth Jetting Systems, Inc., Houston, Tex.

[21] Appl. No.: 58,543

[22] Filed: May 6, 1993

[51] Int. Cl.[5] ..... B08B 7/00

[52] U.S. Cl. ..... 134/18; 134/42

[58] Field of Search ..... 134/18, 42

[56] References Cited

U.S. PATENT DOCUMENTS 4,141,754 2/1979 Frauenfeld ..... 134/37

4,946,513 8/1990 Del Prato et al. ..... 134/18

*Primary Examiner*—Richard O. Dean

*Assistant Examiner*—Zeinab El-Arini

*Attorney, Agent, or Firm*—Jones, Day, Reavis & Pogue

[57] ABSTRACT

A method for automatically cleaning a preheater rotor used in an electrical power plant is disclosed. The method includes controlling with a computer the cleaning of the rotor as well as calculating parameters such as a rate at which the rotor is to be rotated and a time to complete the rotor cleaning based on parameters entered by an operator. The method also controls the movement of a cleaning assembly along the radius of the rotor. An associated apparatus is also disclosed.

8 Claims, 11 Drawing Sheets

AIR PREHEATER CLEANING METHOD

BACKGROUND OF THE INVENTION

1. Field of the Invention

The present invention relates to a computer controlled cleaning tool. More specifically, the present invention relates to a cleaning tool for automatically cleaning a preheater rotor used in electrical power plants.

2. Description of the Related Art

Using high pressure water which is forced through a preheater rotor is well known. Typically, after prolonged use the preheater rotor or rotors of an electrical power plant become coated and clogged with debris such as coal ash. This occurs when hot gases from a plant's combustion process are routed to a preheater rotor, which transfers heat to fresh air routed back to the combustion process to increase the burning efficiency. When the rotors become coated with debris the heat transferring efficiency is reduced and therefore the rotors need to be cleaned periodically.

Typically the preheater rotors are up to twenty feet in diameter and a high pressure water stream of approximately 0.25 inches is applied to the rotor. It can easily be seen that this cleaning process takes a long time, anywhere from 25 to 50 hours depending on the width of the water stream and the rate at which the rotor is rotated past the stream.

There have been attempts made in the past to increase the efficiency and ease of this cleaning. One such attempt includes using programmable logic control (PLC) to move a high pressure water nozzle along a bar extending radially from a hub of the rotor.

This system required an operator to compute how long it would take a rotor to make a complete revolution based on a rotor rotation rate which the operator would independently set. The operator would then compute how long the cleaning would take based on how much of the rotor was to be cleaned and the width of the water nozzle spray. All of the computed parameters would then be entered into the PLC which would then set a timer and move the spray nozzle by an amount equal to the nozzle spray width when the timer indicated the rotor had completed a revolution.

It is therefore desirable to provide a system which would enable only basic direct information, such as inner and outer radii of the rotor, spray width, and the rotor rotation rate or the time to complete the cleaning to be entered and have the cleaning tool automatically clean the area of the rotor bounded by the inner and outer radii.

SUMMARY OF THE INVENTION

It is therefore an object of the present invention to provide an easy-to-use, compact, computerized cleaning tool.

It is a further object of the present invention to provide a cleaning tool which decreases: tool setup time, the number of personnel needed, and the operating steps required of an operator.

It is a still further object of the present invention to provide a cleaning tool wherein an operator simply enters parameters of the cleaning operation and the computer calculates the required information based on the parameters and automatically controls the cleaning operation.

Yet another object of the present invention is to provide a cleaning tool where the cleaning operation can be interrupted and parameters needed to be changed can be entered wherein the computer recalculates the required information based on the change in parameters.

These and other objects are met by the air preheater cleaning tool and method of the present invention and also, in large measure, solves the problems outlined above. A method for automatically cleaning a preheater rotor used in an electrical power plant, comprises the steps of:

(a) providing a computer for controlling the cleaning, the computer includes user interface means;

(b) entering parameters into the computer defining an area of the rotor to be cleaned and one of a rate at which the rotor is to be rotated and a time to complete the rotor cleaning;

(c) calculating with the computer the other of the rotor rotation rate and the time to complete the cleaning;

(d) moving cleaning means operably coupled to the computer to a starting position in response to a signal from the computer;

(e) activating cleaning means wherein the cleaning means produces a predetermined track width;

(f) rotating the rotor at a predetermined speed in response to a signal from the computer such that the cleaning means cleans a predetermined width of the rotor thereby making a clean track on the rotor;

(g) determining with the computer when a complete clean track has been made on the rotor;

(h) moving the cleaning means in response to a signal from the computer so that a portion of the rotor adjacent the previously cleaned portion is cleaned; and (i) repeating steps f, g, and h until the area defined by step b is cleaned.

DESCRIPTION OF THE PREFERRED EMBODIMENT

Figure 1:
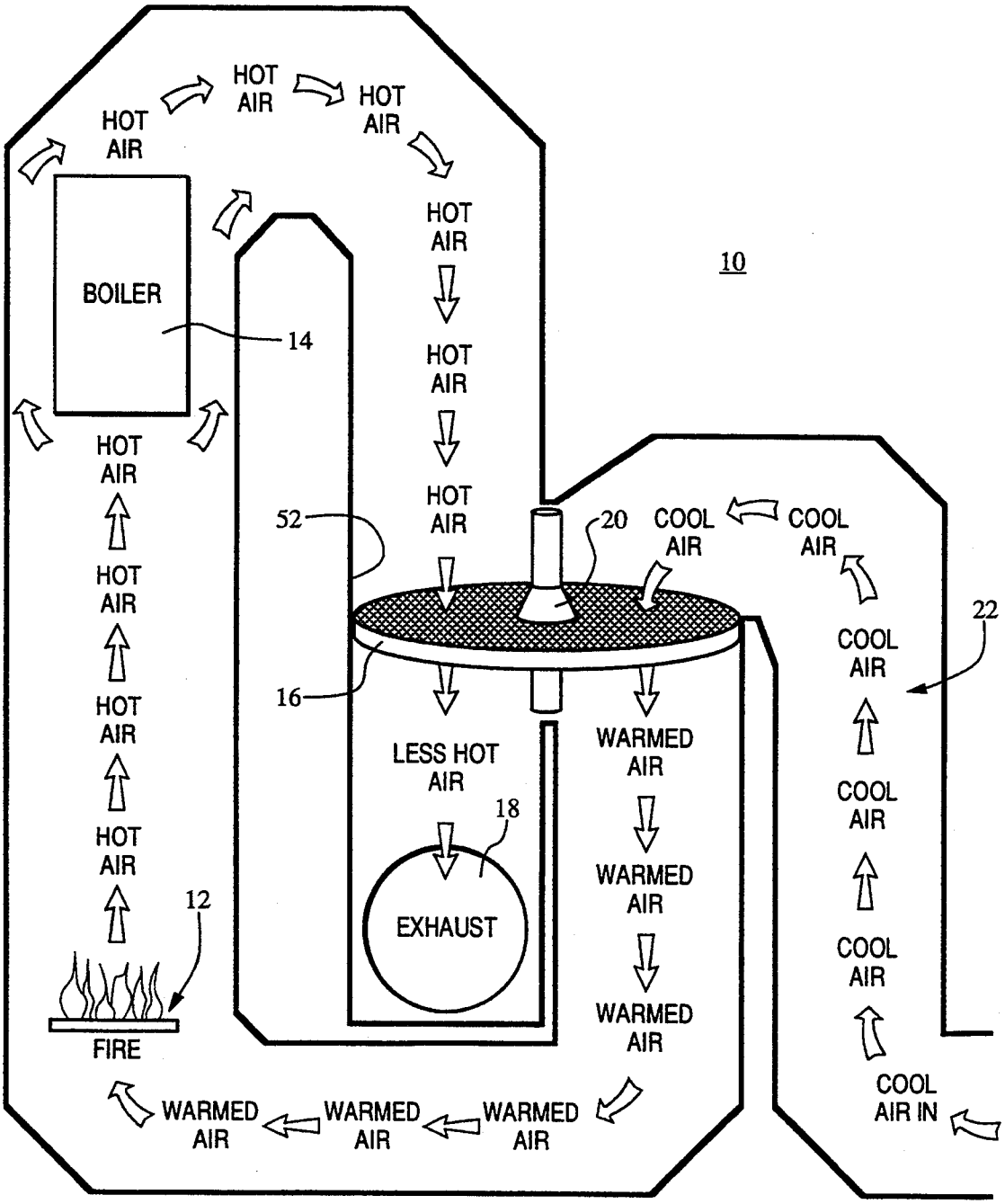
FIG. 1 is a schematic diagram of a preheater rotor in a power plant.

Referring to FIG. 1 an electrical power plant's combustion process is shown generally at 10. The process works by fire 12 heating air which causes boiler 14 to produce steam to the power plant's turbines for producing electricity. The hot area is then circulated through at least one preheater rotor 16. Heat is then transferred to rotor 16 and the now somewhat less hot air which has passed through rotor 16 is exhausted at 18.

Rotor 16 is rotated by a high torque motor and as rotor 16 is rotated fresh, cool air is forced through rotor 16 at an inlet 22. The rotor 16 warms the cool air as the air passes through rotor 16. By warming the fresh air before introducing it to the fire 12 the efficiency of the combustion process is increased by decreasing the fuel needed to heat the air to produce steam for the turbines. The fire 12 is typically fueled by coal or oil that produce debris in the heated air which collects on the rotor 16 as the air passes through rotor 16.

Figure 2:
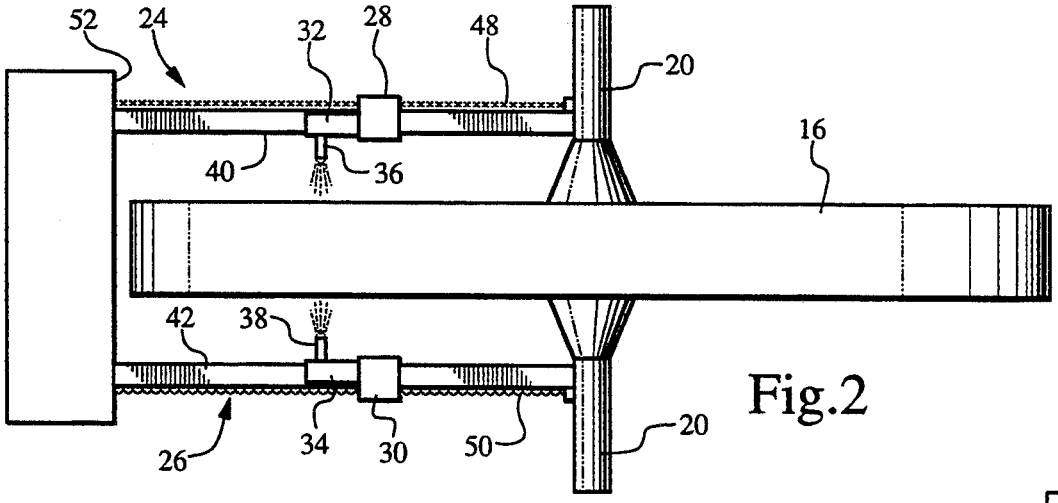
FIG. 2 is a side elevation of the rotor with a pair of cleaning tools attached.
Figure 3:
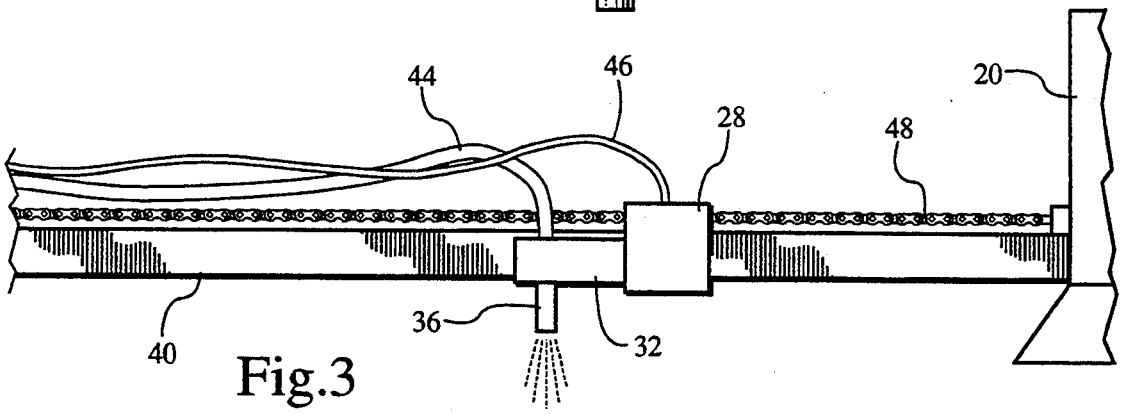
FIG. 3 is a partial view of FIG. 2 showing one of the cleaning tools.
Figure 4:
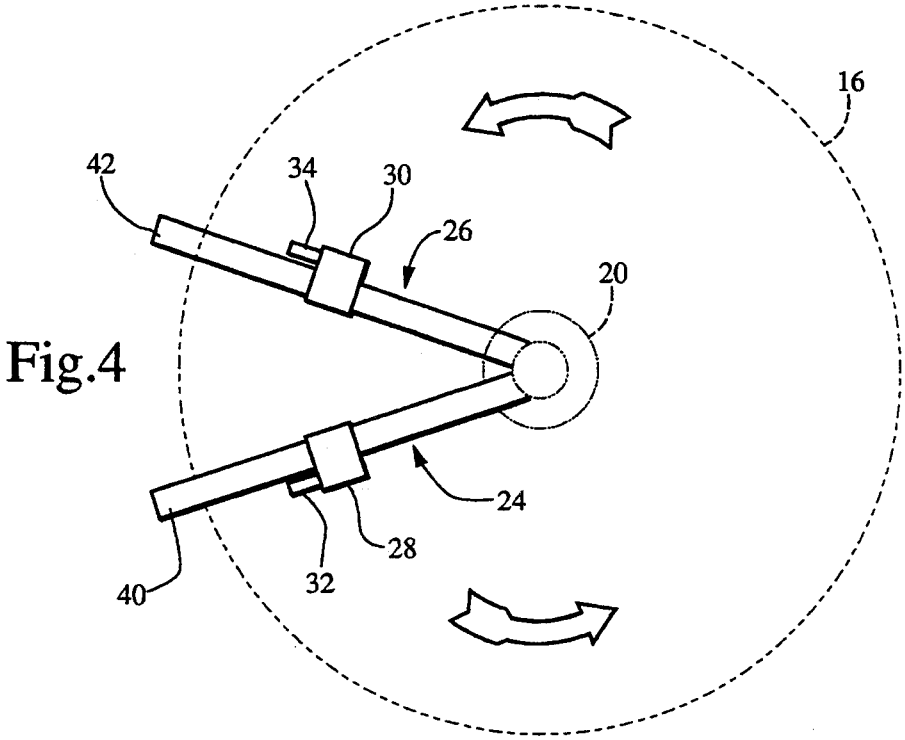
FIG. 4 is a top view of the rotor with the pair of cleaning tools attached wherein the rotor is shown in broken-line.

The accumulation of debris on the rotor 16 decreases heat transfer efficiency of the rotor 16. In order to maintain acceptable heat transfer efficiency it is desirable to clean the rotor 16 periodically. The cleaning is best accomplished by the cleaning tool shown in FIGS. 2–5. The major mechanical components are shown in FIGS. 2–4 and the electronic components shown in FIG. 5. FIG. 2 shows two cleaning assemblies 24 and 26 which are attached to hub 20 adjacent opposite sides of the rotor 16. Cleaning assemblies 24 and 26 are identical and include power heads 28 and 30, nozzle blocks 32 and 34, nozzles 36 and 38, beams 40 and 42, and chains 48 and 50. The power heads 28 and 30 include trolley assemblies (not shown) which are adaptable move along different size beams 40 and 42.

As shown in FIG. 3, a water hose 44 is attached to nozzle 36 in nozzle block 32. Preferably, nozzle block 32 has structure allowing up to 4 hoses 44 to be attached to 4 nozzles 36. Also, power head 28 is connected to a control/power line 46 and uses a chain 48 to move along beam 40. As those skilled in the art are aware beams 40 and 42 are attached to hub 20 and a wall 52 of the preheater. The cleaning assembly 26 also includes a water hose connected to nozzle 38 and a power/control line connected to power head 30 (shown in FIG. 5 at 47).

Preferably, the lower cleaning assembly 26 is positioned so that spray from nozzle 38 will force debris up through rotor 16 before spray from nozzle 36 forces debris back down through rotor 16, as shown in FIG. 4. The beams 40 and 42 should be parallel to rotor 16 to ensure that the maximum force of the spray from nozzles 36 and 38 is applied to rotor 16.

Figure 5:
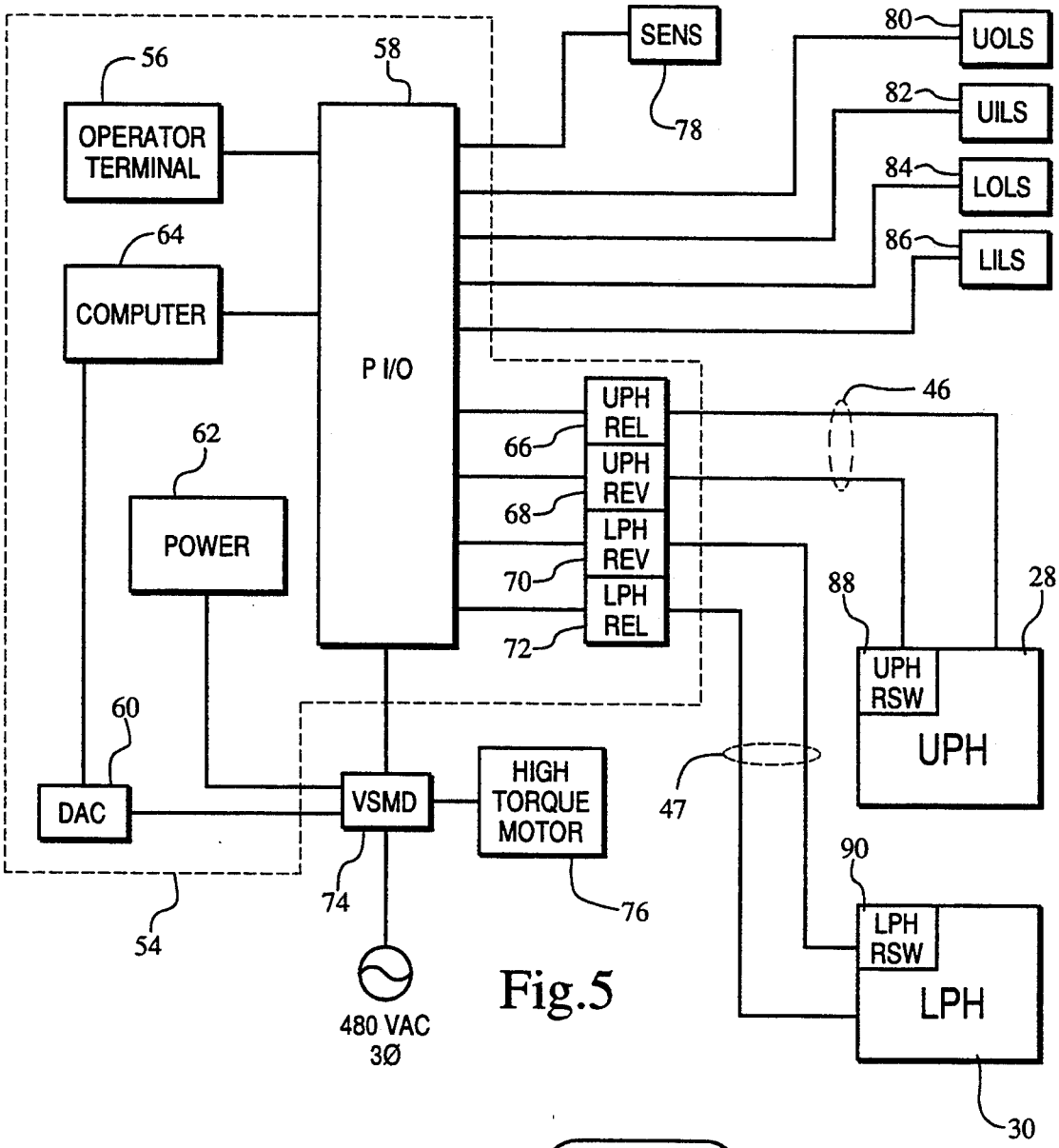
FIG. 5 is a block diagram of the computer and associated components of the cleaning tools for automatically controlling the cleaning of the rotor.
Figure 11:
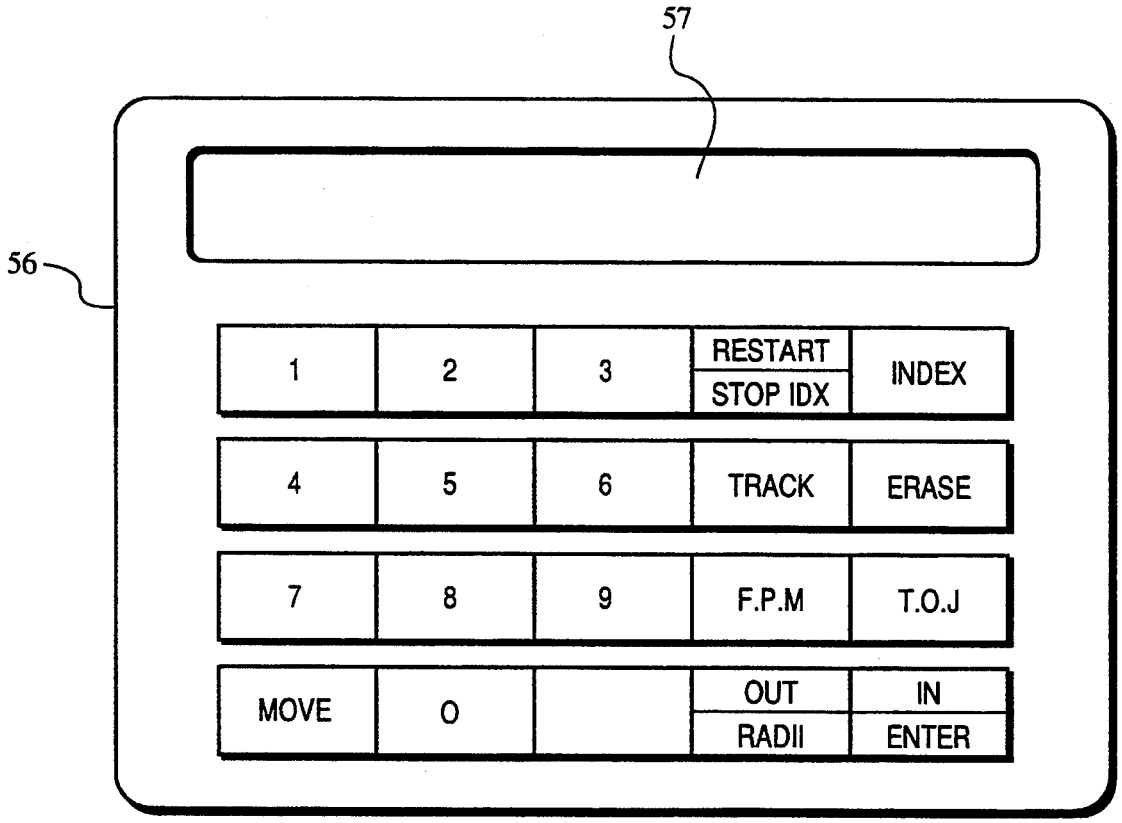
FIG. 11 is an illustration of a preferred operator terminal in accordance with the present invention.

Referring now to FIG. 5, a computer control 54 is shown and includes an operator terminal 56, a parallel input/output interface 58, a digital-to-analog converter 60, a power supply 62, and a computer 64. Control 54 also includes relays 66–72 and terminal 56 preferably includes a keyboard, as shown in FIG. 11, and a display screen 57.

Computer 64 is preferably, a single pc board containing a central processing unit, random access memory, read only memory, and three, eight bit bi-directional parallel ports. The operator terminal is an integrated key input pad for entering parameters into computer 64 defining a cleaning operation, as detailed below. The parallel input/output interface converts higher voltage and current external signals to computer levels and vice versa.

The digital-to-analog converter converts computer information into zero to ten volts for controlling a variable speed motor drive (VSMD) 74. VSMD 74, then causes a high torque motor 76 to rotate rotor 16 at a rate determined by computer 64. VSMD 74 is the power source for a redundant 30 volt power supply 62 from a 480 VAC main supply.

Connected to computer control 54 are an optional infrared sensor 78, limit switches 80–86, and power heads 28 and 30 which include reverse switches 88 and 90. Infrared sensor 78, which includes a sensor and a reflector (not shown) attached to the rotor 16, performs two functions. The main function is for sensor 78 to inform computer 64 when a complete revolution of rotor 16 has occurred. The other function of sensor 78 is to allow computer 64 to calculate a ratio between the motor 76 revolutions per minute and the rotor 16 revolutions per minute. This ratio is typically close to 1750:1.

The limit switches 80–86 are preferably magneticly mounted at inner and outer most points on beams 40 and 42 to indicate to computer 64 when power heads 28 and 30 have reached the end of travel and to protect the power heads 28 and 30 from being damaged.

Once all connections to computer control 54 have been made as shown in FIG. 5 and the power heads 28 and 30 are placed on beams 40 and 42 the rotor is ready to be cleaned. The use of cleaning assemblies 24 and 26 will be explained with reference to assembly 24 in conjunction with the flow charts of FIGS. 6A–10B. The cleaning assembly 26 will move exactly as cleaning assembly 24 because they are aligned to clean the same area of the rotor 16 at any given time.

Figure 6A:
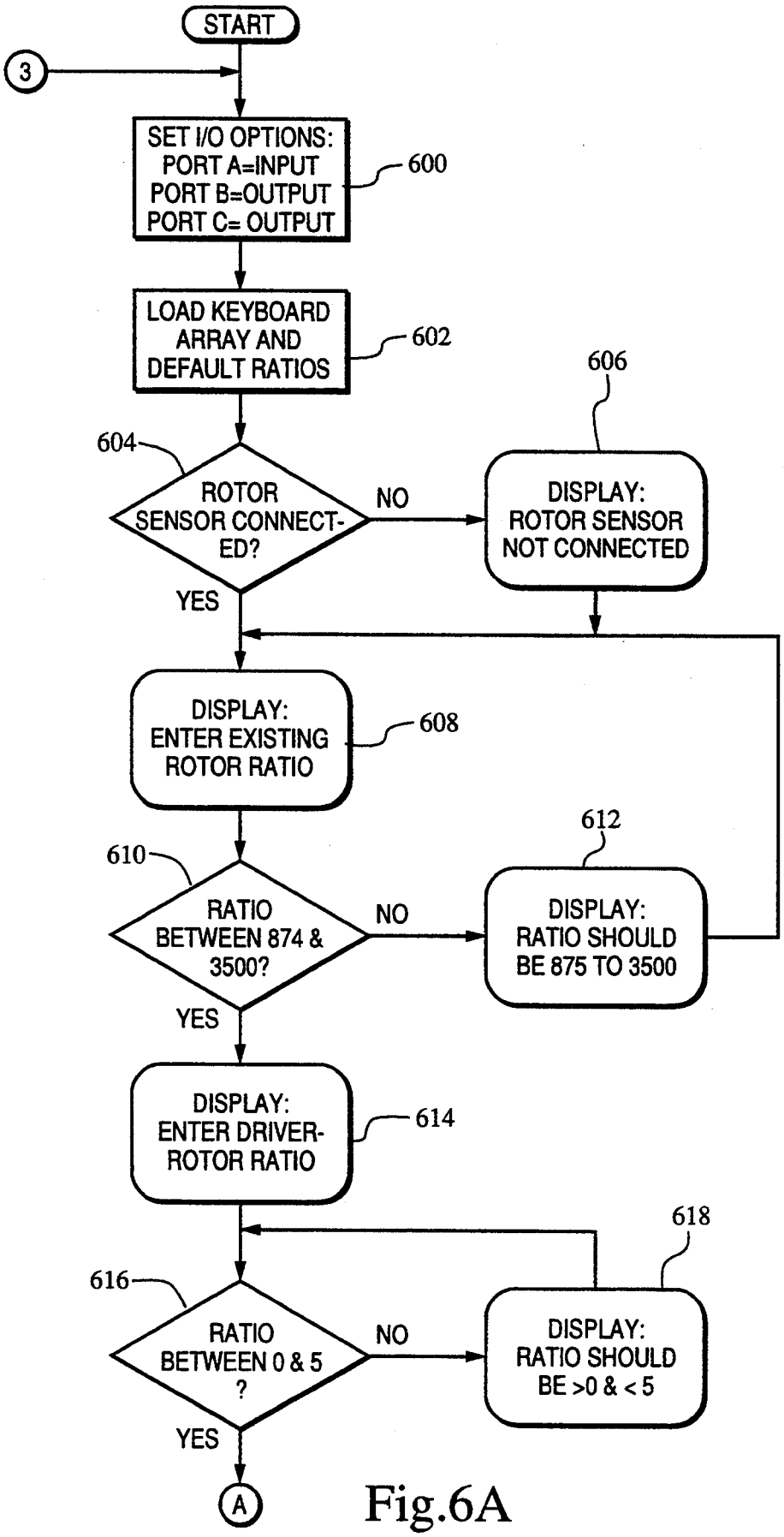
FIGS. 6A–6C are a flow chart of software used by the computer for automatically controlling the cleaning of the rotor.
Figure 6B:
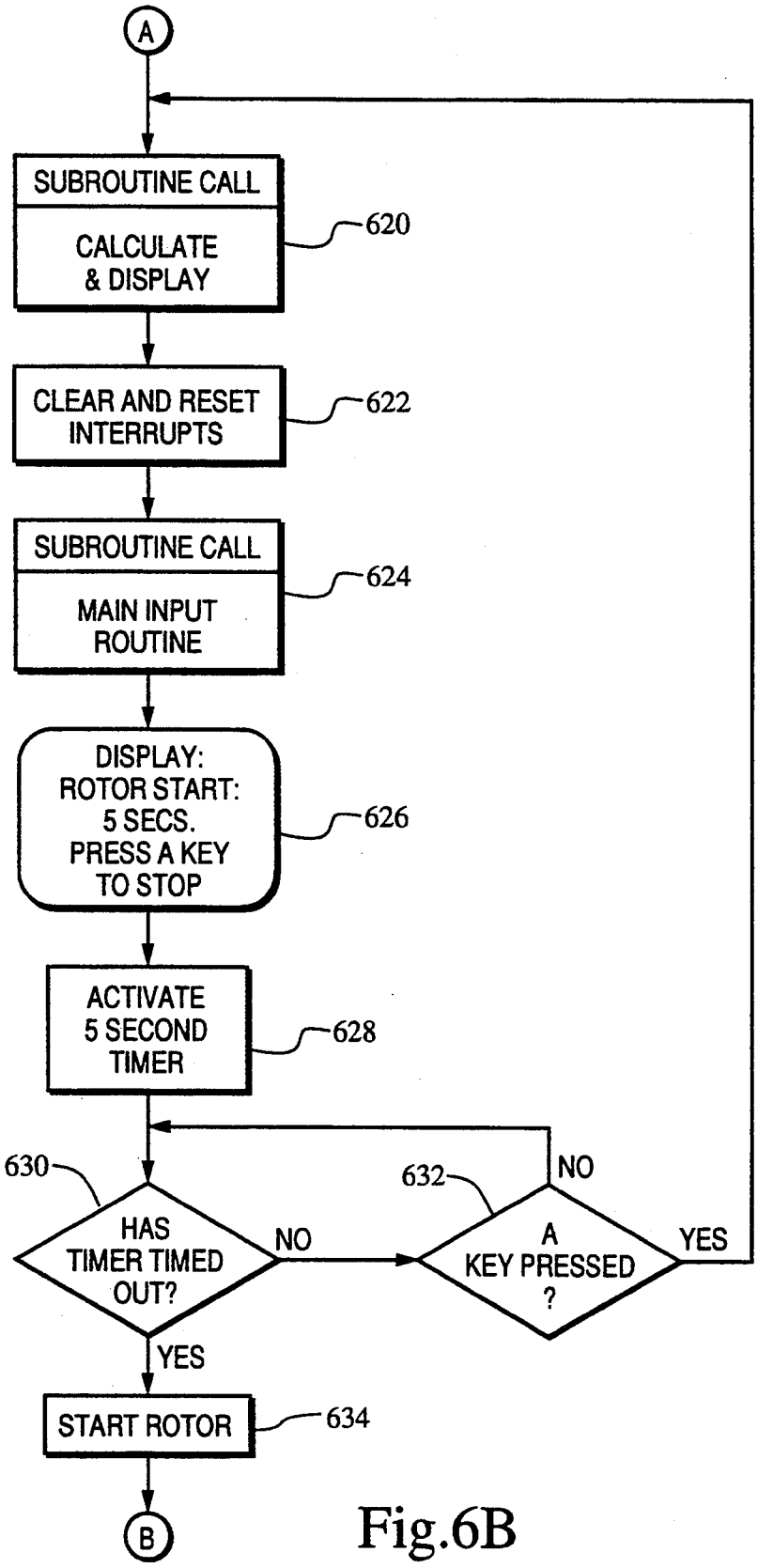
Figure 6C:
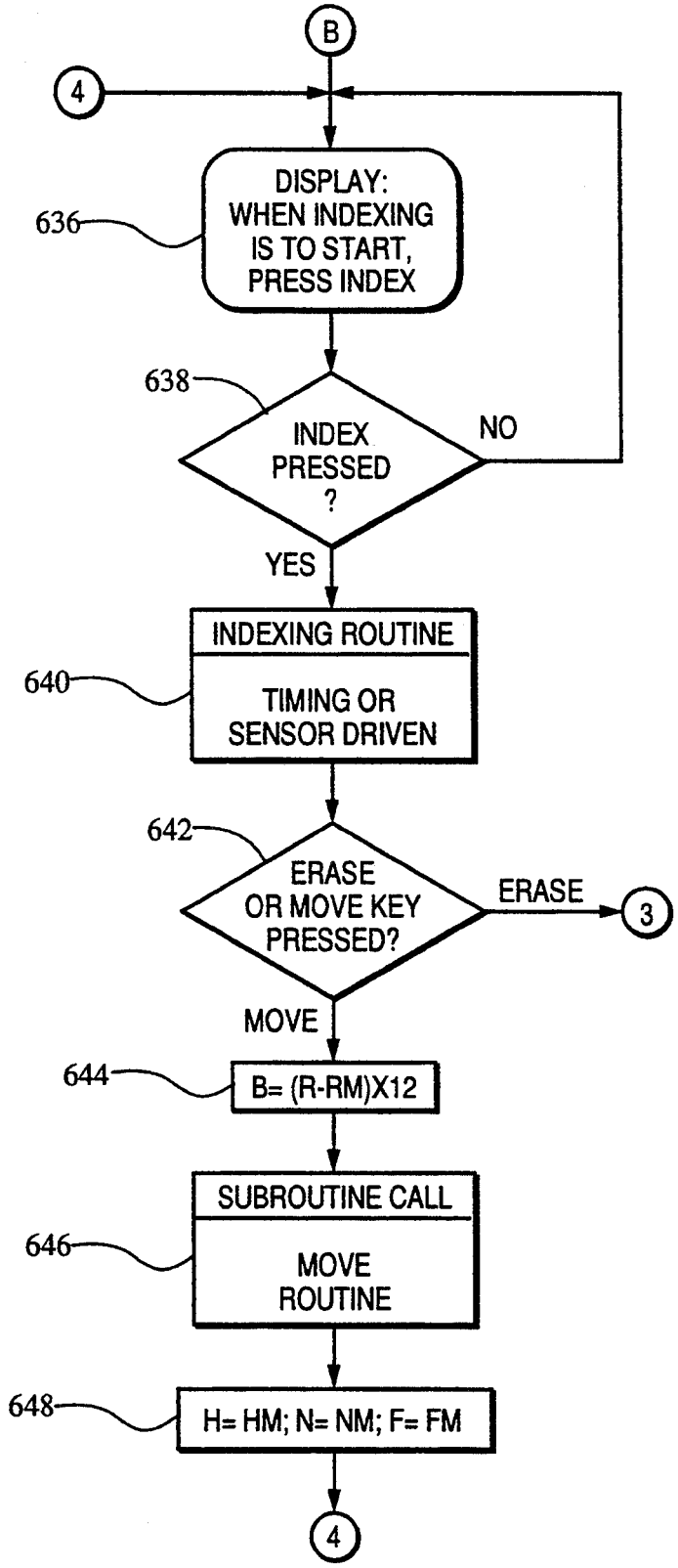

The cleaning operation begins at step 600 of FIG. 6A where computer 64 sets the input/output options as shown. Next, step 602 loads the keyboard array and default ratios. Step 604 determines if rotor sensor 78 is connected; if it is not step 606 causes "Rotor Sensor Not Connected" to be displayed on display 57. The program then proceeds to step 608 which displays "Enter Existing Rotor Ratio ".

Next, step 610 determines if the entered rotor ratio, as explained above is within acceptable limits; if not step 612 causes "Ratio Should Be 875 To 3500" to be displayed and loops back to step 608 until an acceptable ratio has been entered. Step 614 then causes display 57 to tell the operator to "Enter Driver-Rotor Ratio" and step 616 determines if the ratio between the revolutions per minute of the VSMD 74 and the rotor 16 are within acceptable limits. If the ratio is not acceptable step 618 causes the message "Ratio Should Be > & <5" to be displayed and loops back to step 616 until an acceptable ratio is entered.

Figure 7:
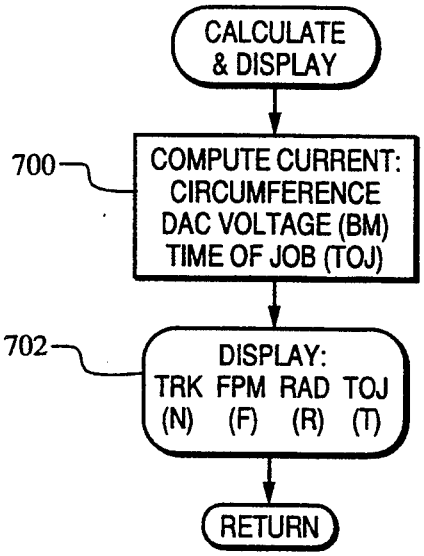
FIG. 7 is a flow chart of a calculate and display subroutine of FIGS. 6A–6C.

The program then calls a calculate and display subroutine at step 620. The subroutine is shown at FIG. 7 and at step 700 causes computer 64 to compute the current circumference of rotor 16 relative to the position of nozzles 36 and 38, a proper DAC 60 voltage (BM), and a time required to complete the cleaning of rotor 16 (TOJ) based on existing default values. Step 702 then causes display 57 to display:

| TRK | FPM | RAD | TOJ |
|---|---|---|---|
| (N) | (F) | (R) | (T) |

where TRK is a track or spray width produced by nozzles 36 and 38 on rotor 16 and N is a number in inches; FPM is the linear feet per minute at which the rotor is rotating and F is a number in feet; RAD is the outer radius of the rotor 16 and R is a number in feet; and TOJ is the time of job and T is a number in hours.

Step 702 will initially display values such as N=0.250, F=20.0, R=20.0, and T=25.0. The program then returns to step 622 which clears and resets all program interrupts. Next, step 624 calls a main input subroutine which is shown in FIG. 8.

Figure 8:
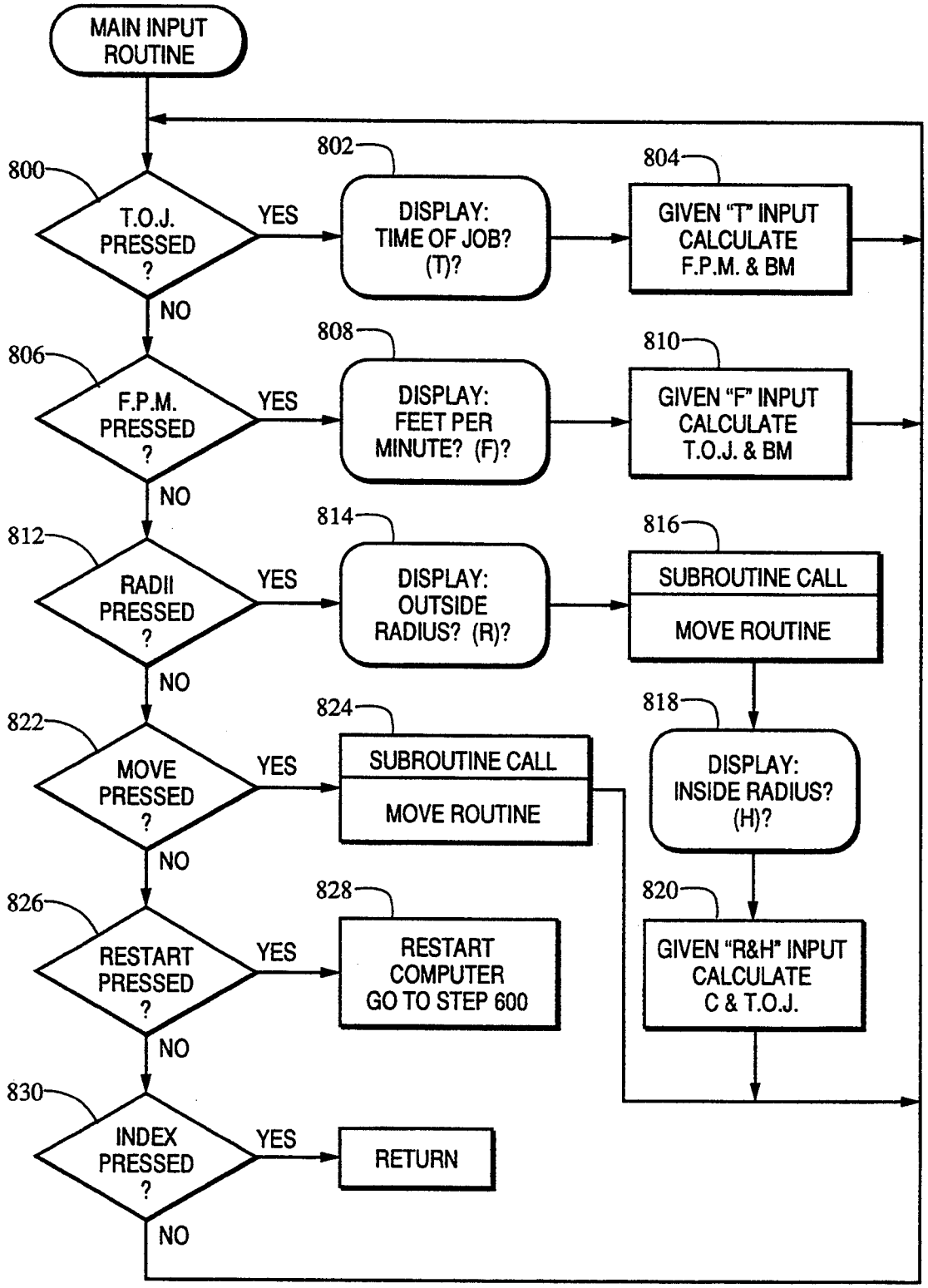
FIG. 8 is a flow chart of a main input subroutine of FIGS. 6A–6C.

Step 800 of FIG. 8 then determines if the T.O.J. key of operator terminal 56 has been pressed. If YES step 802 causes "Time Of Job? (T)?" to be displayed. Once a value T has been entered step 804 causes computer to calculate the required feet per minute at which rotor 16 must be rotated in order to finish the cleaning based on the entered value T and also the required BM (digital to analog voltage) to cause motor 76 to rotate rotor 16 at the required rate. The program the loops back to step 800 where if the T.O.J. key has not been pressed step 806 determines if a F.P.M. key has been pressed.

If the F.P.M. key was pressed step 808 causes "Feet Per Minute? (F)?" to be displayed. Step 810 then causes the T.O.J. and BM to be calculated based on the F input. As can be readily determined if either the F.P.M. or the T.O.J. change the other must necessarily change. The program the loops to step 800 where as above and if the answer to both steps 800 and 806 is NO step 812 determines if a Radii key has been pressed.

Figure 9A:
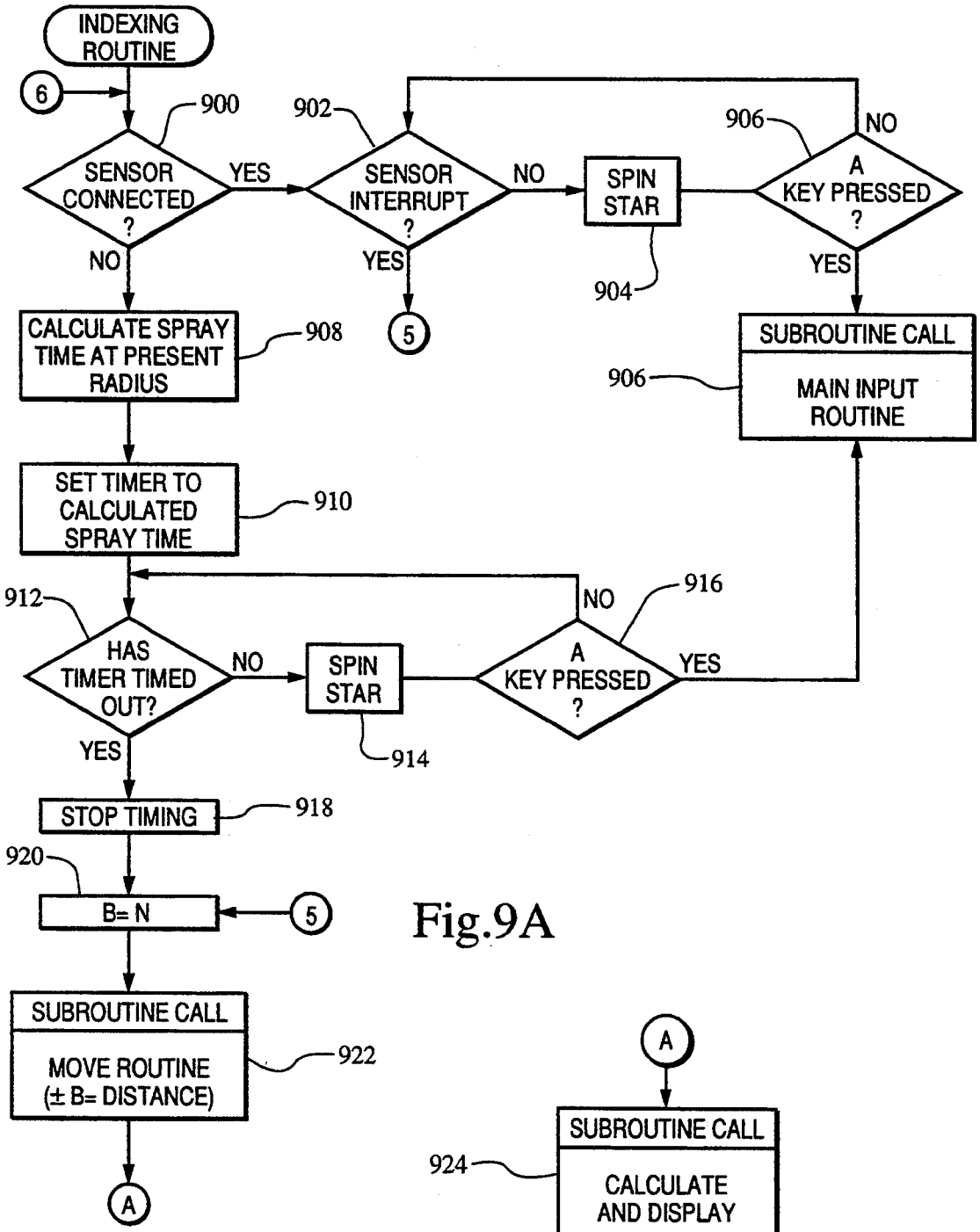
FIGS. 9A and 9B are a flow chart of an indexing subroutine of FIGS. 6A–6C.
Figure 9B:
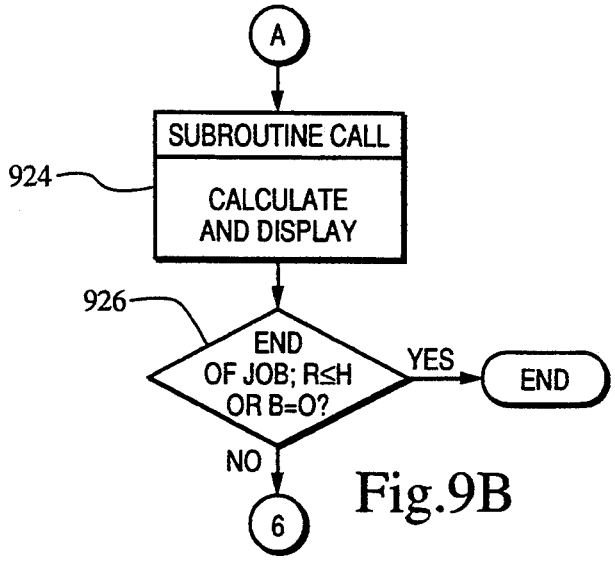
Figure 10A:
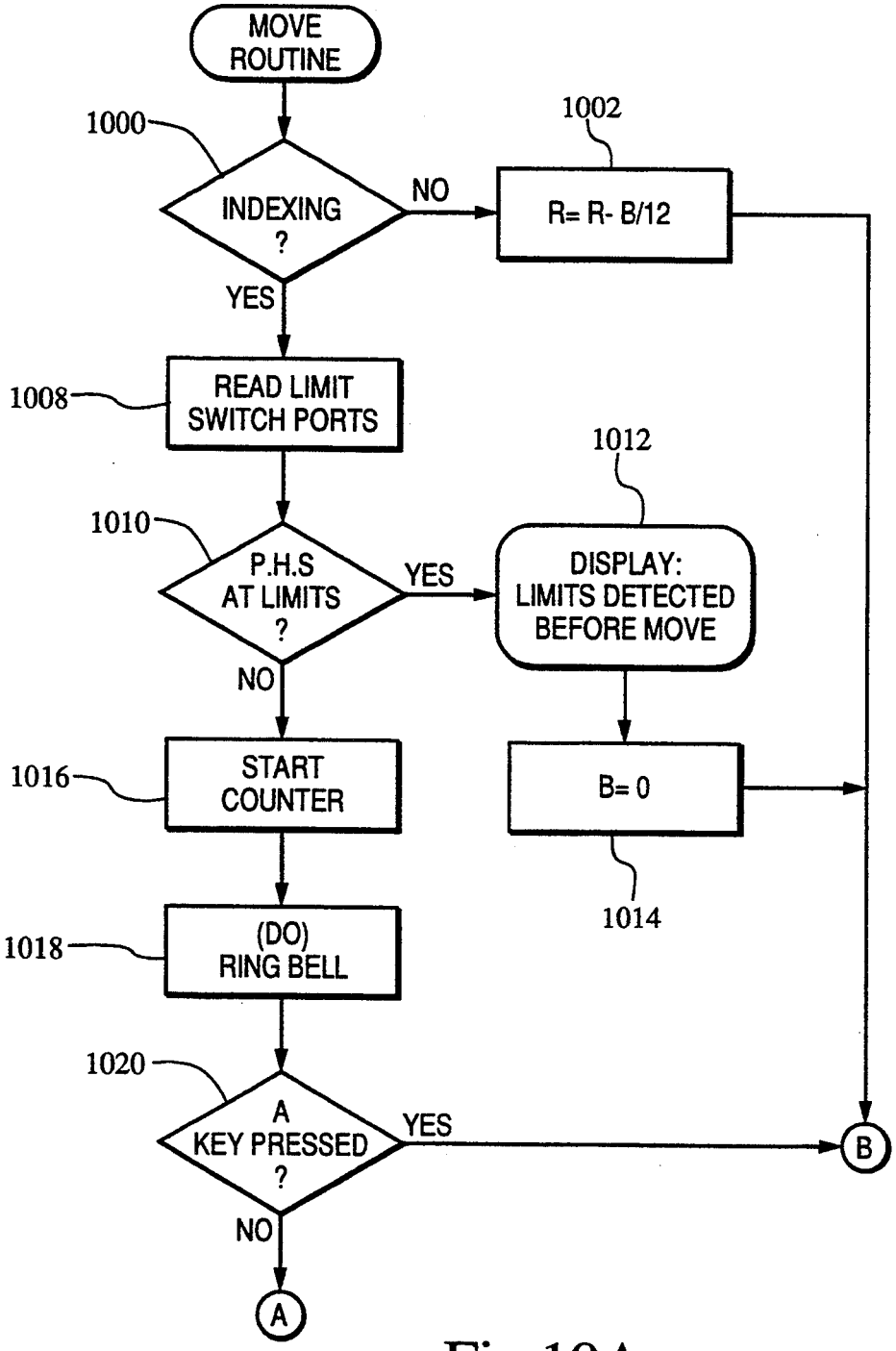
FIGS. 10A and 10B are a flow chart of a move subroutine of FIGS. 6A–6C.
Figure 10B:
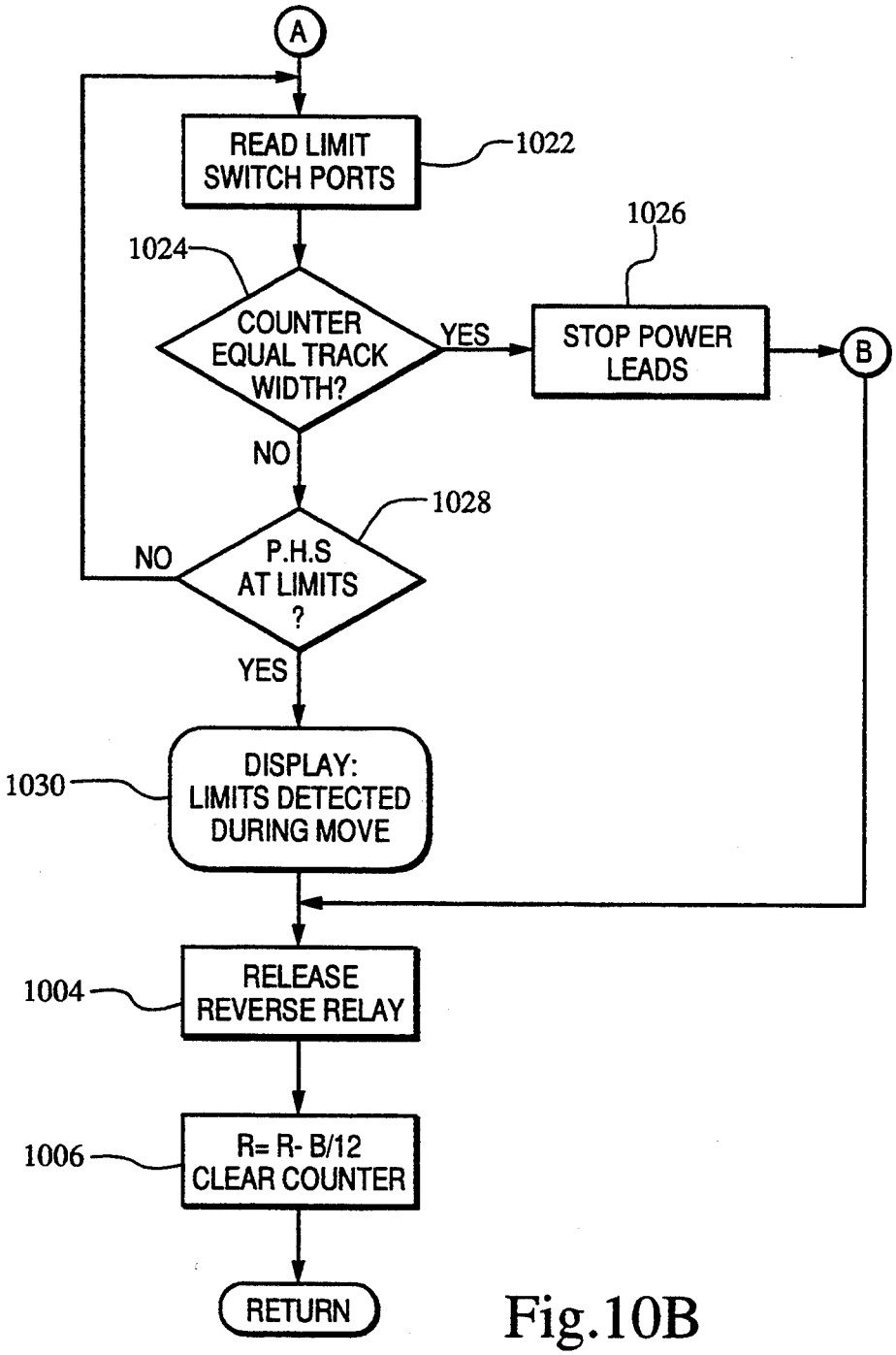

If YES step 814 causes "Outside Radius? (R)?" to be displayed and then step 816 calls a move subroutine shown in FIGS. 10A and 10B. Step 1000 determines if the move is part of an indexing routine of FIGS. 9A and 9B. If NO step 1002 causes computer 64 to move power heads 28 and 30 by an amount equal to a calculated new radius based on the present radius and an amount B by which the power heads 28 and 30 are to move. B should be in inches and is typically the track width of the spray from nozzles 36 and 38. Because B is in inches and R is in feet B is divided by 12. Step 1004 then releases the reverse relays 68 and 70 and step 1006 clears a counter used to determine the distance power heads 28 and 30 have moved.

After the program returns from the move routine step 818 causes "Inside Radius? (H)?" to be displayed. This radius is the inner most radius which is to be cleaned and is typically the hub 20 radius (hence the letter H) but can be any number greater than the hub radius and less than the outside radius. Computer 64 at step 820 then calculates the circumference (C) of the rotor 16 and the T.O.J. The program then loops back to step 800 and if the answers to steps 800, 806, and 812 are NO the program proceeds to step 822 which determines if a Move key has been pressed.

If the Move key has been pressed step 824 calls the move subroutine as explained above and then loops to step 800 again where the programs proceeds to step 826 if the answers to steps 800, 806, 812, and 822 are NO. Step 826 determines if a restart key has been pressed and if YES step 828 causes the computer to restart and the program returns to step 600. If the answer to step 826 is NO step 830 then determines if an Index key has been pressed if YES the routine returns to step 626 and if NO the program loops to step 800 and proceeds as above until the Index key is pressed.

Once the Index key is pressed step 626 causes "Rotor Start: 5 seconds. Press a Key To Stop" to be displayed. Step 628 then activates a 5 second timer and step 630 determines if the timer has timed out. If NO step 632 determines if a key has been pressed. If a key is pressed the program loops to step 620 if not the program loops to step 630 until the timer has timed out. Once the timer has timed out step 634 starts the rotation of the rotor 16.

Next, step 636 causes "When Indexing Is To Start Press Index" to be displayed. Step 638 then determines if the Index key has been pressed; if NO the program loops to step 636 until it is pressed. Step 640 then calls an indexing routine which can be either timing or sensor driven, as explained below. Before the Index key is pressed an operator must activate the cleaning assemblies 28 and 30 by turning on a high pressure water supply.

Step 900 of the indexing routine of FIG. 9A determines if sensor 78 is connected if YES the routine will be sensor driven and proceeds to step 902 and determines if a sensor interrupt has occurred. If no sensor interrupt has occurred step 904 causes display 57 to indicate that cleaning is occurring by displaying something such as a spinning star symbol. Step 906 then determines if any key of operator terminal 56 has been pressed. If NO the program loops to step 902, if YES step 906 call the main input subroutine of FIG. 8 as explained above. When step 902 detects a sensor interrupt the program jumps to step 920 explained below.

On the other hand if sensor 78 is not connected at step 900 the indexing routine will be timing driven and step 908 causes computer 64 to calculate the spray time at the current radius. Step 910 then sets a timer to the calculated spray time and step 912 determines if the timer has timed out. If NO step 914 causes a star to spin on display 57 as a step 904. Step 916 then determines if a key has been pressed. If YES the program proceeds to step 906 and if NO loops back to step 912.

If a key is not pressed before the timer of step 912 times out step 918 stops the timing and step 920 sets a value B equal to the track width N, where B is an amount by which the power heads 28 and 30 are to move. Step 922 then calls a move subroutine, shown in FIGS. 10A and 10B, with the + and − signs indicating whether power heads are to be moved in or out.

In this case the answer to step 1000 will be YES and step 1008 will read the limit switches 80–86. Step 1010 then determines if the power heads 28 and 30 are at their limits. If YES step 1012 displays "Limits Detected Before Move" and step 1014 sets B equal to zero and the program returns to step 924 after steps 1004 and 1006. If the power heads 28 and 30 are not at their limits at step 1010 step 1016 moves power heads 28 and 30 and starts a counter to determine how far the power heads 28 and 30 have moved. Step 1018 causes a bell to ring to indicate to the operator that the power heads 28 and 30 are moving.

Next, step 1020 determines if a key has been pressed; if YES the program returns to step 924 after steps 1004 and 1006. If the answer to step 1020 is NO step 1022 reads the limit switches 80–86 to determine if the power heads 28 and 30 have reached their limits. Step 1024 then determines if the counter equals B which has been set to the track width N. If YES step 1026 stops the power heads 28 and 30 and the cleaning continues. If the answer to step 1024 is NO step 1028 determines if the power heads 28 and 30 are at any of their limits. If step 1028 is NO the program loops to step 1022 but if the answer is YES step 1030 causes "Limits Detected During Move" to be displayed and the power heads 28 and 30 are stopped and after steps 1004 and 1006 the program returns to step 924.

After the program returns from the move subroutine step 924 calls the calculate and display subroutine explained above to determine the circumference of the present radius and the require DAC voltage and FPM. Next, step 926 determines if this is the end of the job by determining if $R \leqq H$ or $B=0$ and if the answer to either is YES the cleaning is end if NO the program loops to step 900.

The indexing routine will continue uninterrupted until the entire area of the rotor 16 defined by the inner and outer radii has been cleaned. While the indexing routine is running step 642 determines if the move or erase keys of terminal 56 have been pressed. If the erase key is pressed the program returns to the beginning at step 600.

If, however, the move key is pressed step 644 determines how far the power heads 28 and 30 are to move by the formula shown in step 644, where B=the distance to be moved, R=a new radius to which the power heads are to be moved, and RM=the radius at which the power heads are currently located. Step 646 then calls the move routine of FIGS. 10A and 10B as explained above. Next, step 648 sets the values of H, N, and F into memory which are then used to calculate new parameters when there is a change in any one parameter. The program the loops back to step 636 and proceeds as explained until the cleaning is completed or aborted.

As those skilled in the art will appreciate, it is noted that substitutions may be made for the preferred embodiment and equivalents employed herein without departing from the scope of the present invention as recited in the claims. For example, other types of ways to move the power heads 28 and 30 may be employed as well as various types of sensors and switches.

I claim:

1. A method for automatically cleaning a preheater rotor used in an electrical power plant, the method comprising the steps of:

(a) providing a computer for controlling the cleaning, said computer including user interface means;

(b) entering parameters into the computer defining an area of the rotor to be cleaned and one of a rotor rotation rate and a time to complete the rotor cleaning;

(c) calculating with the computer the other of the rotor rotation rate and the time to complete the rotor cleaning;

(d) moving cleaning means operably coupled to the computer to a starting position in response to a signal from the computer;

(e) activating cleaning means wherein said cleaning means produces a track width;

(f) rotating the rotor at a speed in response to a signal from the computer such that said cleaning means a width of the rotor thereby making a clean track on the rotor;

(g) determining with the computer when a complete clean track has been made on the rotor;

(h) moving said cleaning means in response to a signal from the computer so that a portion of the rotor adjacent the previously cleaned portion is cleaned; and (i) repeating steps f, g and h until the area defined by step b is cleaned.

2. The method of claim 1 further including the steps of:

(j) interrupting the method at step h in response to a signal from said computer;

(k) entering parameters into said computer defining a second area of the rotor to be cleaned;

(l) moving cleaning means operably coupled to the computer to a position to begin cleaning said second area; and (m) repeating steps f, g and h until the area defined by step k is cleaned.

3. The method of claim 2 wherein said steps b and k include the steps of:

displaying on display means a present set of parameters including the track width of said cleaning means, the rate at which the rotor is rotated, inner and outer radii of the rotor, and a time to complete the present cleaning;

entering data representative of a change in at least one of the parameters;

calculating with the computer one of a second time to complete the cleaning and a second rotor rotation rate based on the change in parameters;

displaying on said display means a set of parameters based on the change in the parameters; and performing steps d through m in response to the change in parameters.

4. The method of claim 3 wherein moving said cleaning means includes moving at least a first water nozzle attached to a pressurized water source wherein the water nozzle is attached to a first moveable power head coupled to a first bar member extending radially from a hub of said rotor for spraying water through said rotor to produce said clean track.

5. The method of claim 4 wherein rotating said rotor includes controlling a variable speed motor drive coupled with said computer, said variable speed motor drive being operably coupled with a motor for rotating said rotor.

6. The method of claim 5, step g including the further step of sensing with sensing means when said rotor has rotated a full revolution.

7. The method of claim 6 wherein said sensing means includes an infrared sensor.

8. The method of claim 7 wherein moving said cleaning means includes moving at least a second water nozzle attached to the pressurized water source wherein the second water nozzle is attached to a second moveable power head coupled to a second bar member extending radially from the hub of said rotor for spraying water through said rotor in a direction opposite of said first nozzle to produce said clean track.

* * * * *

UNITED STATES PATENT AND TRADEMARK OFFICE

CERTIFICATE OF CORRECTION

PATENT NO. : 5,366,561

DATED : Nov. 22, 1994

INVENTOR(S) : Ginn

It is certified that error appears in the above-indentified patent and that said Letters Patent is hereby corrected as shown below:

Column 4, line 57, after "$>$" and before "&", insert -- 0 --.

Column 8, line 32, after "the" and before "cleaning", insert -- rotor --.

Signed and Sealed this

Nineteenth Day of September, 1995

*Attest:*

Bruce Lehman

BRUCE LEHMAN

*Attesting Officer*

*Commissioner of Patents and Trademarks*